US005263819A

United States Patent [19]

O'Leary et al.

[11] Patent Number: 5,263,819

[45] Date of Patent: Nov. 23, 1993

[54] PAIRED FLYING DISKS

[76] Inventors: Michael J. O'Leary; Steven D. Wolfe, both of 3101 Shoreline Dr., #931, Austin, Tex. 78728

[21] Appl. No.: 072,882

[22] Filed: Jun. 7, 1993

[51] Int. Cl.[5] ..... A63H 27/00

[52] U.S. Cl. ..... 446/48; 446/46

[58] Field of Search ..... 446/46–48; 273/424, 425, 428; D21/86, 85

[56] References Cited

U.S. PATENT DOCUMENTS

| | | | |
|---|---|---|---|
| D. 181,641 | 12/1957 | Gotsch | D21/86 |
| 3,359,678 | 12/1967 | Headrick | 446/46 |
| 3,724,122 | 4/1973 | Gillespie | 446/46 |
| 3,855,728 | 12/1974 | Hynds | 446/46 |
| 4,182,073 | 1/1980 | Tabet | 446/46 |
| 4,184,284 | 1/1980 | Rogahn | 446/48 X |
| 4,205,484 | 6/1980 | Kovac et al, | 446/46 |
| 4,212,131 | 7/1980 | Ross | 446/48 |
| 4,370,824 | 2/1983 | Resnicow | 446/48 |
| 4,752,267 | 6/1988 | Layman | 446/46 |

*Primary Examiner*—Mickey Yu

[57] ABSTRACT

Paired flying disks utilizing in-flight aerodynamic induced separation. A second disk is nested within a first disk so that such can be easily thrown together as one flying disk and provide repeatable vertical separation in flight. The outer or larger disk has vanes above corresponding openings and/or holes employed in body of the disk to divert air from the top side or other location to the underside thereof to assist the separation of the disks from one another in flight. After separation, both disks follow the same flight direction making it possible for a single person to consistently catch both of the disks.

4 Claims, 3 Drawing Sheets

PAIRED FLYING DISKS

BACKGROUND OF THE INVENTION

1. Field of the Invention.

This invention relates to aerodynamic toys. More specifically, it is directed to a toy consisting of a special combination of two nested flying disks with one of the disks provided with aerodynamic vanes to improve dual disk flying performance.

2. Related Art.

Flying disk toys have long been known to the prior art. These toys have become increasingly more popular due to the success of the flying toy sold under the trademark FRISBEE as described by U.S. Pat. Nos. 3,359,678 and 3,724,122. These flying disks are generally formed or molded from a plastic material in the shape of a saucer having a curved convex upper surface and a corresponding concave lower surface with a thick rim at its periphery. The rim is thicker than the rest of the saucer in order to provide a gyroscopic action critical to the aerodynamic features of the toy. Throwing is usually performed by placing the thumb on the convex upper side and one or more fingers on the concave lower side, thereby grasping the rim, and with a wrist snapping motion releasing the disk with a spin as it moves forward. Rotational motion and forward momentum cause the toy to fly or glide through the air. The recreational appeal of this toy is the fact that it exhibits definite aerodynamic characteristics and can be made to perform a number of various maneuvers depending upon the skill of the user. Several different kinds of games have been developed from the throwing and catching of this kind of flying disk.

One variation in the use of flying disks is the throwing and catching of two flying disks at the same time. Such a use creates a variety of new games and fun between two or more persons. For example, a simple game is when two or more players, separated by about 75 to 100 feet, throw the two disks simultaneously to each other with the requirement that both disks be caught by one individual. Points are assigned according to the players' performance. Other games using both disks present unique challenges to a player's timing and coordination skills.

The first attempt at improving the performance of paired flying disks is the device shown in U.S. Pat. No. 3,855,728 to William B. Hynds. This toy consists of two concentrically sized flying disks in which a smaller disk is nested within a larger disk in a manner which allows the disks to be thrown as a single flying disk. However, the inner disk is not anchored to the outer disk while grasping. Without this capability, the position of both disks at the initial release of a throw will not be parallel. This can cause premature separation and poor performance. Also, the separation generated by the inner disk's undulated surface does not result in a repeatable flight pattern that can easily be caught by one person unless the thrower is of exceptional skill.

Another prior effort to design paired flying disks is found in U.S. Pat. No. 4,212,131 to Alexander D. Ross, Jr. This patent discloses a pair of identically shaped flying disks which can be stacked one above another and thrown as a plurality of units. However, because these disks are stacked, the overall height of both disks require a throwing grasp different than that of a single flying disk. In addition, like Hynds, the separation generated by the relative position of the disks does not result in a repeatable flight pattern where both disks can be easily caught by one person unless the thrower is of exceptional skill.

Relevant prior art is also found in U.S. Pat. No. 4,370,824 by Herbert Resnicow which discloses a single flying disk with angulated vane openings at equispaced points about its perimeter. This toy utilizes vanes, openings and/or holes to enhance the lift imparted to the device.

Other pertinent examples of flying disks include those revealed in U.S. Pat. Nos. 4,182,073 by Tabet and 4,752,267 by Layman. Tabet's invention is a rotary aircraft toy with two disk-shaped members secured together. Layman's patent discloses a double flying disk with two disks permanently fastened together in a vertical stacked relation by a plurality of collapsible rings.

Though the above mentioned prior arts have individual qualities and characteristics, they can be improved to provide a pari of disks that feel as one disk when thrown, greater throwing predictability with respect to separation and flight pattern of the disks with less skill required, and thereby better marketability. Most flying disk enthusiasts have at least on one occasion or another picked up two flying disks at the same time and used their same tossing technique in the hope that both flying disks will have a successful trajectory. The results are typical—one flying disk assumes a somewhat normal flight pattern while the other disk either falls quickly to the ground or has an unpredictable flight pattern. The marketing success of a paired flying disk toy requires that the device does not require an extraordinary amount of experience or skill to have fun. Repeated attempts at successful play should result in a quantifiable return in expertise level. When the use of paired flying disks results in erratic and unpredictable behavior, the toy loses its recreational appeal. The devices referred to by the prior art in paired flying disks do not perform in a repeatable manner with respect to separation and flight pattern of the disks after separation; therefore, the skill or expertise required tended to be much greater than that of the average user and thereby makes the devices less marketable.

SUMMARY OF THE INVENTION

To achieve such improvements, my invention comprises an aerial toy which includes a set of paired flying disks, with one smaller diameter disk nested within a larger diameter disk. On the outer disk, vanes above corresponding openings are employed in the body of the disk in order to divert air from the top side of the disk down through the openings to the underside of the outer disk during in-flight rotation, thereby tending to force the outer disk upwardly and separating it from the inner nested disk. The vanes, in conjunction with the openings, induce vertical separation of the outer disk from the inner disk. Once the disks separate in flight, the outer disk flies more slowly than the inner disk due to the increased drag caused by the vanes, thus causing the outer disk to arrive more slowly than the inner disk. This feature makes it easier for a single person to catch both disks.

The outer disk further employs a protuberance or thickened portion, and perhaps plural protuberances, extending downwardly from the lower side of the main body of the outer disk. This protuberance fits into a matching notch found at a corresponding location of the upper side of the inner disk and is used to keep the inner disk centered and anchored within the outer disk while nested.

The lower surface of the outer disk has a concentric cylindrical rib, and perhaps plural concentric cylindrical ribs, extending downwardly and increasing in extension as they occur progressively further from the center of the disk. The rib or the outer disk make the lower surface of the outer disk match the outer surface of the inner disk. These ribs are designed so that both disks have similar outer surface aerofoil profiles and comparable weights. This assures similar aerodynamic flight performance of both disks after separation.

The rib or ribs, in combination with the protuberance or protuberances, anchor the inner disk to the outer disk in order to hold both disks parallel during the initial release of both disks. This prevents premature separation and establishes the best starting flight position for utilizing the outer disk's ability to generate an in-flight aerodynamic induced separation. After this type of separation, both disks follow the same flight direction making it possible for a single person to catch both disks.

Both disks are provided with a rim or skirt around their periphery, preferably of a thickness greater than the bodies of the disks. The bottom edge of the rim or skirt of the inner disk terminates above the horizontal plane of the bottom edge of the rim or skirt of the outer disk when the inner disk is nested within the outer disk with the upper surface of the main body of the inner disk flush against the lower surface of the outer disk. This, along with the above mentioned rib or ribs, allows both disks to be held together in a throwing grasp that is similar to a single flying disk.

Accordingly, the objectives of this invention are to provide, inter alia,

1. A flying toy which includes a pair of flying disks which when nested together provides the same throwing grasp and feel of a single flying disk so that no new or additional skills are required other than that of a single flying disk thrower,
2. A flying toy which includes a pair of flying disks which when thrown together generates an in-flight, aerodynamic induced, repeatable, vertical separation, and
3. A flying toy which includes a pair of flying disks which when thrown by one person will separate, maintain close proximity to one another, and then land in the same desired area such that one individual can catch both disks.

These and other objects and advantages of the invention will become more apparent to those skilled in the art by reference to the following specification, drawings and attendant claims.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
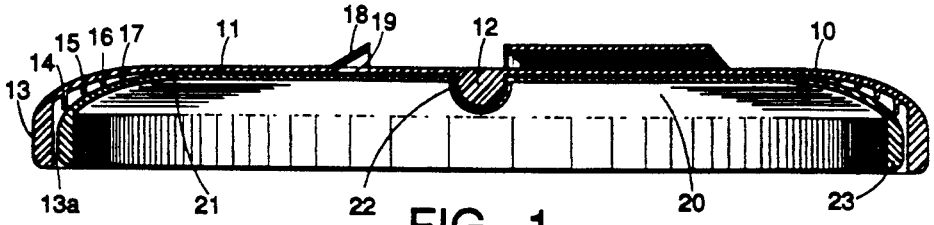
FIG. 1 is a sectional view taken along lines 6—6 in FIG. 2 used to show the disks in a nested position along with the vanes of the outer disk, with the ribs of the outer disk and the protuberance used to center the disks.

The preferred embodiment of my invention is illustrated in FIGS. 1, 2, 5 and 6. FIG. 1 is a cross-sectional view of the inner disk nested within the outer disk, the outer disk depicted as 10 and the inner disk depicted as 20, along line 6—6 of FIG. 2. Referring to FIG. 1, there is shown the two disks which constitute the paired flying disks. The outer disk 10 includes a circular substantially flat main body portion 11. The inner disk 20 also has a circular main body portion 21 which is of a smaller diameter than the main body portion 11 of the outer disk 10.

Figure 2:
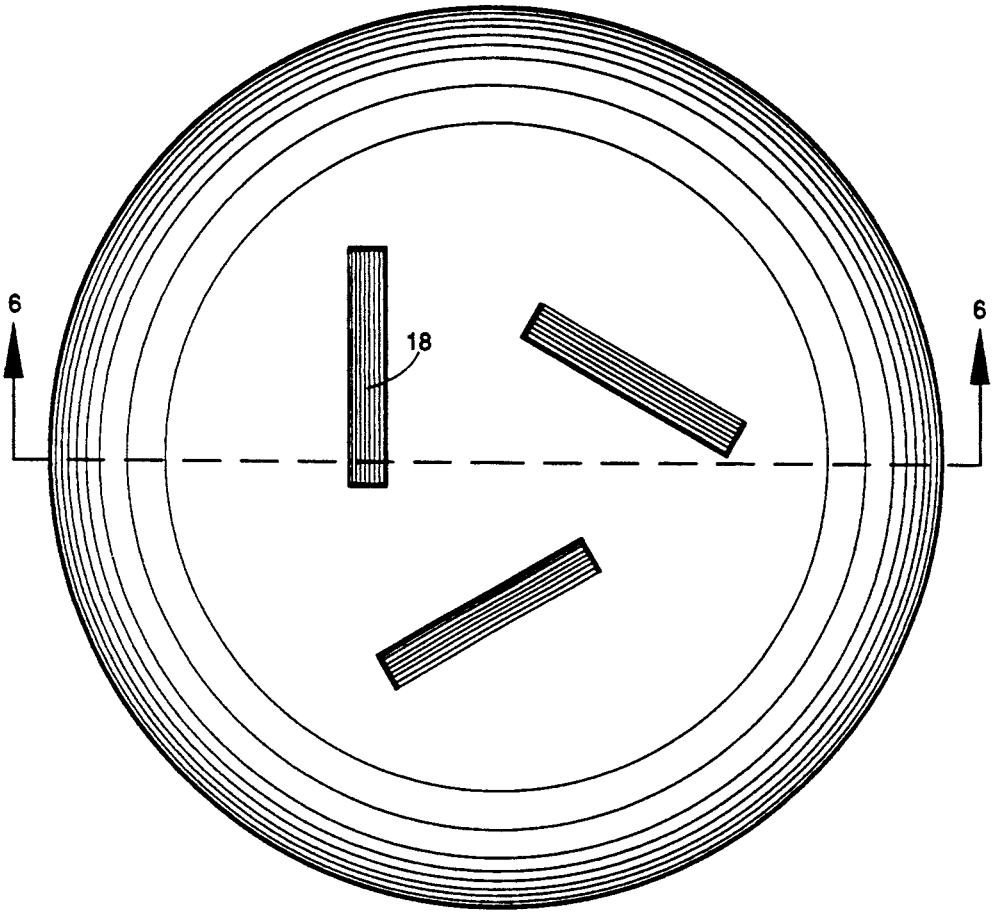
FIG. 2 is a top elevational view of the outer disk with the vanes situated for a right-handed thrower.
Figure 5:
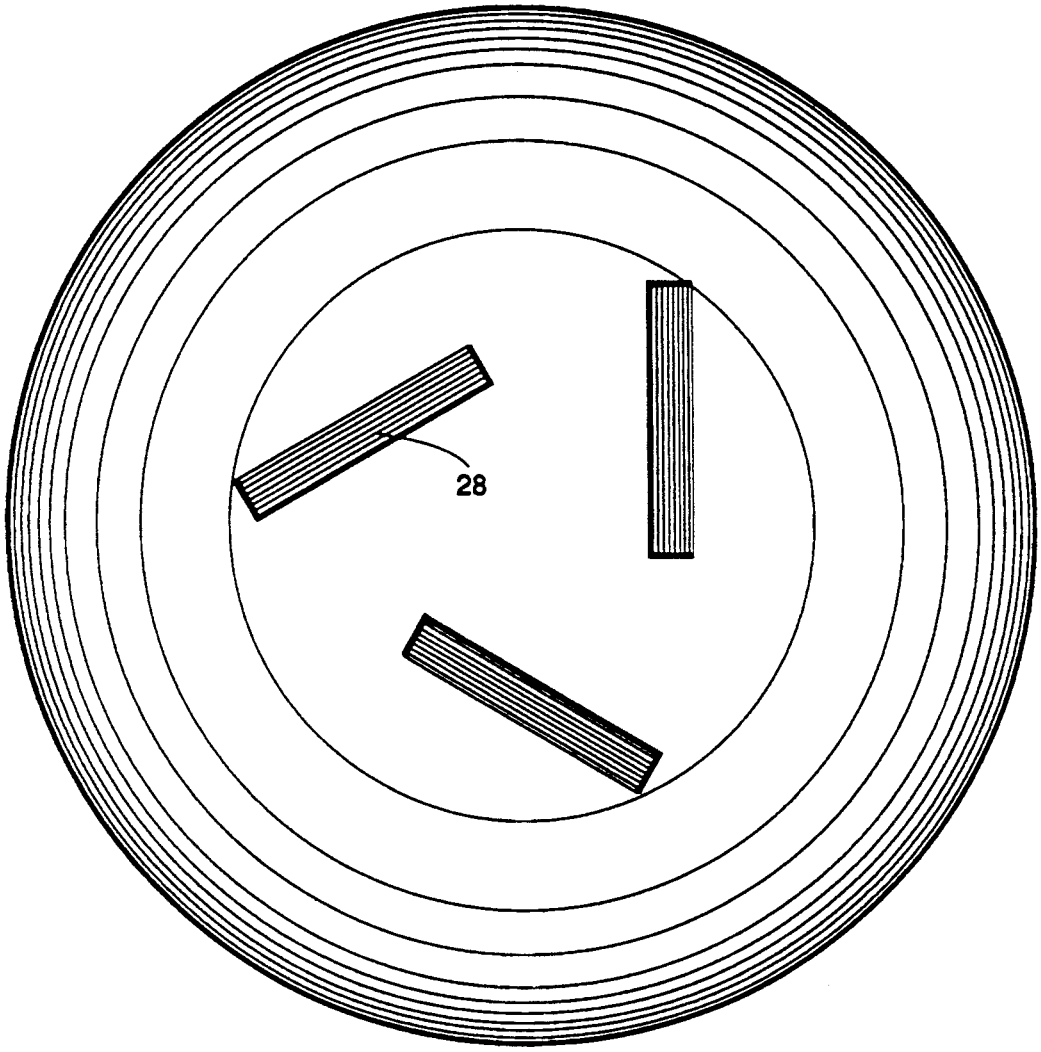
FIG. 5 is a top elevational view of the outer disk with the vanes situated for a left-handed thrower.
Figure 6:
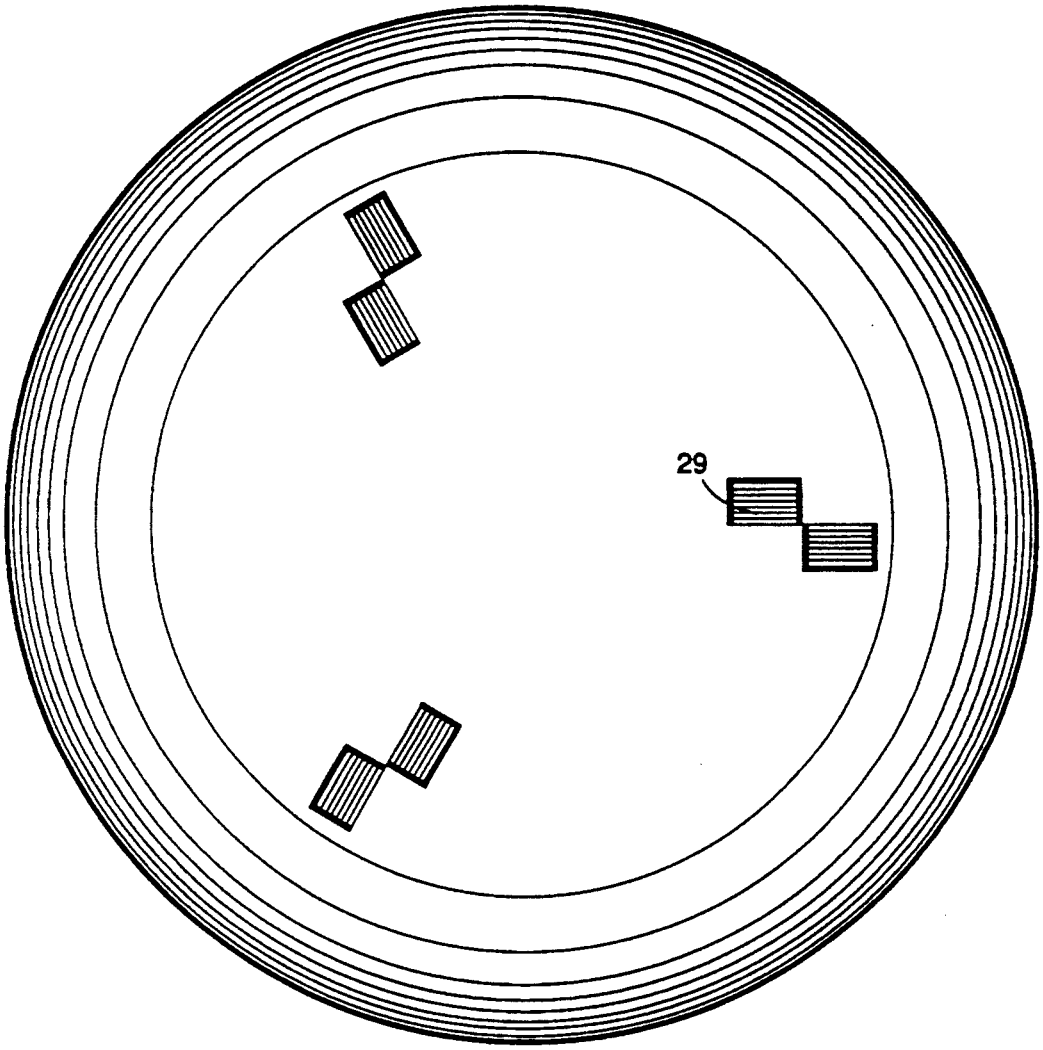
FIG. 6 is a top elevational view of the outer disk with the vanes situated for either a right-handed or left-handed thrower.

FIGS. 1, 2, 5 and 6 illustrate a plurality of vanes 18, 28 and 29. FIGS. 2, 5 and 6 are top elevational views of the outer disk 10 of FIG. 1. The vanes 18, 28 and 29 are oriented on the upper disk's 10 surface in a circular pattern at equispaced points about the main body portion 11. It should also be understood that the vane or vanes may be of any suitable size, shape and location as long as during in-flight rotation they divert air flow from the top side through the opening or hole 19 to underside of the outer disk 10. Experimental results have revealed that the size, shape, placement and number of vanes on the outer disk 10 yield a wide range of in-flight separation performance.

The vanes 18, 28 and 29 shown in FIGS. 1, 2, 5 and 6 were selected because of their flight performance and streamline appearance. During rotation, the vanes 18, 28 and 29 function much like a rotor to divert air inwardly and downwardly to the underside of the outer disk 10, thereby forcing the paired disks to vertically separate in flight. Also, the positioning of the vanes 18, 28 and 29 determine which type of rotation will induce in-flight separation. The vanes 18 shown in FIGS. 1 and 2 are positioned for clockwise rotation, the direction which would be imparted to the device by a right-handed thrower; the vanes 28 shown in FIG. 5 are positioned for counter-clockwise rotation, the direction which would be imparted to the device by a left-handed thrower; and the vanes 29 shown in FIG. 6 are positioned for either clockwise or counter-clockwise rotation. The vanes illustrated in FIGS. 2 and 5 provide the best performance in flight, while those in FIG. 6 would allow the greatest marketability. Another embodiment of this invention could include moveable vanes positioned such that either clockwise or counter-clockwise rotation will induce separation. Once the disks separate in flight, the outer disk 10 flies more slowly than the inner disk 20 due to the increased drag caused by the vanes 18, 28 and 29, thus causing the outer disk to arrive more slowly than the inner disk 20. This feature makes it easier for a single person to catch both disks.

The outer disk 10 is provided with a protuberance 12 which is found on the under side of the outer disk 10. The protuberance 12 is used to center and anchor the inner disk 20 when nested inside the outer disk 10 by fitting into a matching notch 22 found centered on the main body portion 21 of the inner disk 20. The protuberance 12 and notch 22 should be designed such that the protuberance 12 fits snugly within the notch 22 so as to keep the inner disk 20 from moving once nested within the outer disk 10, yet not so snug as to prevent the disks from separating in flight.

As shown in FIG. 1, a series of downwardly extending cylindrical ribs or walls 14–17 are found on the underside of the outer disk 10. Each rib is concentric and radially spaced from the other ribs, with the first cylindrical rib 14 radially spaced from the outer disk rim 13. The number of cylindrical ribs may be varied as desired to provide both disks with comparable weights and similar outer surface aerofoil profiles. This assures similar aerodynamic flight performance of both disks after separation. The cylindrical ribs 14–17, in combination with the protuberance 12 and matching notch 22, tend to aide in securing the inner disk 20 while nested within the outer disk 10. Thus, both disks are held parallel during the initial release of both disks which establishes the best starting flight position that will utilize the outer disk 10 ability to generate an in-flight aerodynamic induced separation.

The outer edge of the main body portion 11 of the outer disk 10 curves downwardly and terminates in a vertically extending rim 13 which circumscribes the main body portion 11. The inside edge 13*a* of the rim 13 is substantially vertically to a horizontal plane. A downwardly extending rim 23 circumscribes the main body portion 21 of the inner disk 20. Similar to the outer disk 10, the rim 23 of the inner disk 20 extends downwardly from the main body portion 21 at a right angle to the horizontal plane parallel to the rim of the outer disk 10. The inner rim 23 terminates above the outer rim 13 as illustrated in FIG. 1 so as to provide a comfortable grasp and feel as one disk when throwing the paired flying disks together.

Both disks may be constructed of any suitable polymer such as are presently being utilized for the single disks described in more detail in the above mentioned patents. However, both disks should be constructed of the same polymer so that no difference in density and other physical properties occur. If the disks are made different materials, they could have different coefficients of thermal expansion. This would cause them to expand and/or contract at different rates depending upon their temperature. This can cause problems in the performance of the invention in that should the outer disk 10 expand or contract faster than the inner disk 20 so that the inner disk 20 outside diameter exceeds the inside diameter of the outer disk 10, the disks could possibly fail to separate in flight.

Figure 3:
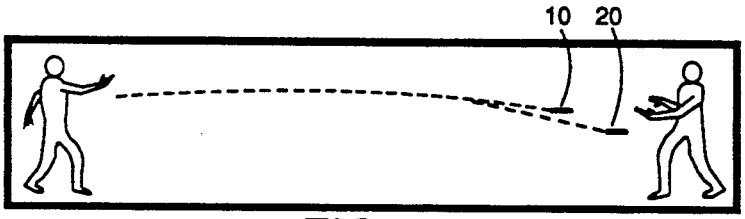
FIG. 3 is a diagrammatic sketch illustrating a side view of an aerodynamic toy being thrown wherein a pair of disks separate and continue in the same direction.
Figure 4:
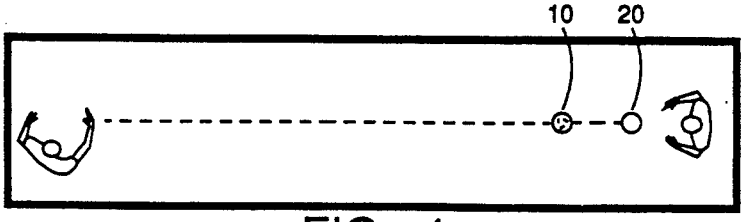
FIG. 4 is a diagrammatic sketch illustrating a top view of an aerodynamic toy being thrown wherein a pair of disks separate and continue in the same direction.

As can be seen in FIGS. 3 and 4, an individual is throwing to another individual the paired flying disks which includes a larger diameter flying disk 10 which has a smaller diameter flying disk 20 nested therein. In throwing the disks, a wrist snapping motion is utilized with the thrower usually standing at an approximate right angle to the direction that he desires to throw the disks. The disks are normally grasped in one hand with the thumb carried on top of the upper disk 10 and one or more fingers pressing against the bottom side of the lower disk 20. Only minimal skill is required so that when thrown the disks continue together in the same direction after they separate, such as shown in both FIG. 3 side elevation and from the top elevation in FIG. 4. With both of the disks continuing in the same direction as shown in FIGS. 3 and 4, it is possible for a single player to catch one disk in one hand and the other disk in the other hand.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. An improved paired flying disk toy designed to be thrown through the air comprising:

(a) a first disk having a circular substantially flat main body portion, said main body having a top side and an underside, a downwardly extending rim circumscribing said main body portion;

(b) a second disk removably received within said first disk having a circular main body portion of a smaller diameter than said first disk, said main body of said second disk having a top side and an underside, a downwardly extending rim circumscribing said main body portion;

(c) a bottom edge of said rim of said second disk terminating above a horizontal plane of a bottom edge of said rim of said first disk when said second disk is nested within said first disk with an upper surface of said main body of said second disk flush against a lower surface of said first disk;

(d) at least one protuberance projecting downwardly from the underside of said first disk into at least one notch found on the top side of said second disk to anchor said second disk within said first disk when said second disk is nested within said first disk with an upper surface of said main body of said second disk flush against a lower surface of said first disk; enabling said disks to be thrown together for separating in flight.

2. A toy in accordance with claim 1 wherein said top side of said first disk has vanes or openings for aiding in separation of said disks while in flight permitting air to be drawn into the underside of said first disk thereby pushing said disks apart.

3. A toy in accordance with claim 1 wherein at least one cylindrical rib extends downwardly from the underside of said first disk for aiding in securing said disks to one another when said second disk is nested within said first disk with an upper surface of main body of said second disk flush against a lower surface of said first disk thereby preventing an erratic separation of said disks during flight.

4. A method of sailing paired flying disks that comprises:

nesting an inner disk inside an outer disk, said inner disk being of smaller diameter than said outer disk;

anchoring the nested inner disk to the outer disk, the anchoring being done by a series of cylindrical ribs and one or more protuberances on the underside of the outer disk, which protuberances fit snugly into a notch or notches on the upperside of the inner disk, and which cylindrical ribs prevent the inner disk from moving out of its nested position when grasped so that both disks feel as one; and separating said paired disks when thrown by drawing air through one or more vanes found on the top side of said outer disk thereby forcing paired disks apart in flight, said cylindrical ribs acting to prevent an erratic separation in flight so that both disks continue along similar flight paths, and said vanes creating an aerodynamic drag on said outer disk so that said outer disk sails more slowly than said inner disk, thereby enabling one person to catch both disks.

* * * * *